US011090961B2

(12) United States Patent
Kosuge

(10) Patent No.: US 11,090,961 B2
(45) Date of Patent: Aug. 17, 2021

(54) HEAD PRESSURIZING MECHANISM AND TAPE PRINTING APPARATUS

(71) Applicant: SEIKO EPSON CORPORATION, Tokyo (JP)

(72) Inventor: Shinsaku Kosuge, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/882,861

(22) Filed: May 26, 2020

(65) Prior Publication Data

US 2020/0406652 A1 Dec. 31, 2020

(30) Foreign Application Priority Data

Jun. 26, 2019 (JP) ..... JP2019-119072

(51) Int. Cl.

| | |
|---|---|
| ***B41J 25/312*** | (2006.01) |
| ***B41J 2/335*** | (2006.01) |
| ***B41J 2/325*** | (2006.01) |
| ***B41J 3/407*** | (2006.01) |
| ***B41F 16/00*** | (2006.01) |
| ***B41J 3/36*** | (2006.01) |
| ***B41J 11/04*** | (2006.01) |

(52) U.S. Cl.

CPC ..... *B41J 25/312* (2013.01); *B41F 16/0073* (2013.01); *B41F 16/0093* (2013.01); *B41J 2/325* (2013.01); *B41J 2/33505* (2013.01); *B41J 3/36* (2013.01); *B41J 3/4075* (2013.01); *B41J 11/04* (2013.01)

(58) Field of Classification Search

CPC ..... B41J 25/312; B41J 2/33505; B41J 2/325; B41J 3/4075; B41J 3/36; B41J 11/04; B41J 2/32; B41J 11/0025; B41F 16/0093; B41F 16/0073

See application file for complete search history.

(56) References Cited

U.S. PATENT DOCUMENTS

| | | | | |
|---|---|---|---|---|
| 10,589,540 | B2 * | 3/2020 | Sasaki | B41J 15/04 |
| 2018/0297374 | A1 | 10/2018 | Sasaki | |

FOREIGN PATENT DOCUMENTS

| | | | |
|---|---|---|---|
| JP | H11-309907 | A | 11/1999 |
| JP | 2002-166606 | A | 6/2002 |
| JP | 2018-176713 | A | 11/2018 |

* cited by examiner

*Primary Examiner* — Huan H Tran
(74) *Attorney, Agent, or Firm* — Oliff PLC

(57) ABSTRACT

A head pressurizing mechanism in which in a state in which a first tape cartridge is mounted, a first contact pin is positioned at a first switching position in which the first contact pin comes in contact with a pressure receiving portion provided on a side of a thermal head opposite a platen roller, and in a state in which the second tape cartridge is mounted, by pushing the pressurizing position switching portion in a mounting direction with the second tape cartridge, a second contact pin is positioned at a second switching position in which the second contact pin comes in contact with the pressure receiving portion at, with respect to the first switching position, a portion in a direction opposite the mounting direction.

6 Claims, 10 Drawing Sheets

HEAD PRESSURIZING MECHANISM AND TAPE PRINTING APPARATUS

The present application is based on, and claims priority from JP Application Serial Number 2019-119072, filed Jun. 26, 2019, the disclosure of which is hereby incorporated by reference herein in its entirety.

BACKGROUND

1. Technical Field

The present disclosure relates to a head pressurizing mechanism that applies pressure to a thermal head, and to a tape printing apparatus.

2. Related Art

Hitherto, as disclosed in JP-A-11-309907, a head pressurizing mechanism including a pressing portion member provided on a side opposite a platen with respect to a print head, and a head pressing member that presses the pressing portion member towards a thermal head is known. The head pressurizing mechanism includes a lift-up arm that moves the pressing portion member up and down in order to change the position where the pressing portion member applies pressure to the thermal head in accordance with a width of tape accommodated in a tape cartridge. The lift-up arm is provided so as to be pivotable like a seesaw, and when one end portion is pushed down by the tape cartridge, the other end portion pushes up the pressing portion member.

In the known head pressurizing mechanism, the position where the pressure is applied to the thermal head is changed by moving the pressing portion member in a direction opposite a direction in which the tape cartridge is mounted. Accordingly, the lift-up arm is needed to move the pressing portion member to the direction opposite the direction in which the tape cartridge is mounted, which creates an issue such as the head pressurizing mechanism becoming bulky.

SUMMARY

A head pressurizing mechanism of the present disclosure that presses a thermal head towards a platen roller, the thermal head being provided in a cartridge mounting portion on which a first tape cartridge and a second tape cartridge, each accommodating tape of a different width, are selectively mounted, the head pressurizing mechanism including a pressurizing position switching portion provided on a side opposite the platen roller with respect to the thermal head, and a pressurizing portion that applies pressure to the thermal head through the pressurizing position switching portion. In the head pressurizing mechanism, the pressurizing position switching portion includes a first contact portion and a second contact portion provided, with respect to the first contact portion, in a direction opposite a mounting direction of the first tape cartridge and the second tape cartridge. In a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion in the mounting direction with the second tape cartridge, the second contact portion is positioned at a second switching position in which the second contact portion comes in contact with the pressure receiving portion at, with respect to the first switching position, a portion in a direction opposite the mounting direction.

A tape printing apparatus of the present disclosure includes a cartridge mounting portion on which a first tape cartridge and a second tape cartridge, each accommodating tape of a different width, are selectively mounted, a thermal head provided in the cartridge mounting portion, and a head pressurizing mechanism that presses the thermal head towards a platen roller. In the tape printing apparatus, the head pressurizing mechanism includes a pressurizing position switching portion provided on a side opposite the platen roller with respect to the thermal head, and a pressurizing portion that applies pressure to the thermal head through the pressurizing position switching portion. The pressurizing position switching portion includes a first contact portion, and a second contact portion provided, with respect to the first contact portion, in a direction opposite a mounting direction of the first tape cartridge and the second tape cartridge. In a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion in the mounting direction with the second tape cartridge, the second contact portion is positioned at a second switching position in which the second contact portion comes in contact with the pressure receiving portion at, with respect to the first switching position, a portion in the direction opposite the mounting direction.

DESCRIPTION OF EXEMPLARY EMBODIMENTS

Referring hereinafter to the attached drawings, an exemplary embodiment of a head pressurizing mechanism and a tape printing apparatus will be described. Note that X-Y-Z rectangular coordinate systems depicted in the following drawings are illustrated merely for convenience of description and do not limit the following exemplary embodiment in any way. Furthermore, the numerical values indicating the number of portions are described merely as examples and do not limit the following exemplary embodiment in any way.

Tape Printing Apparatus and Tape Cartridge

Figure 1:
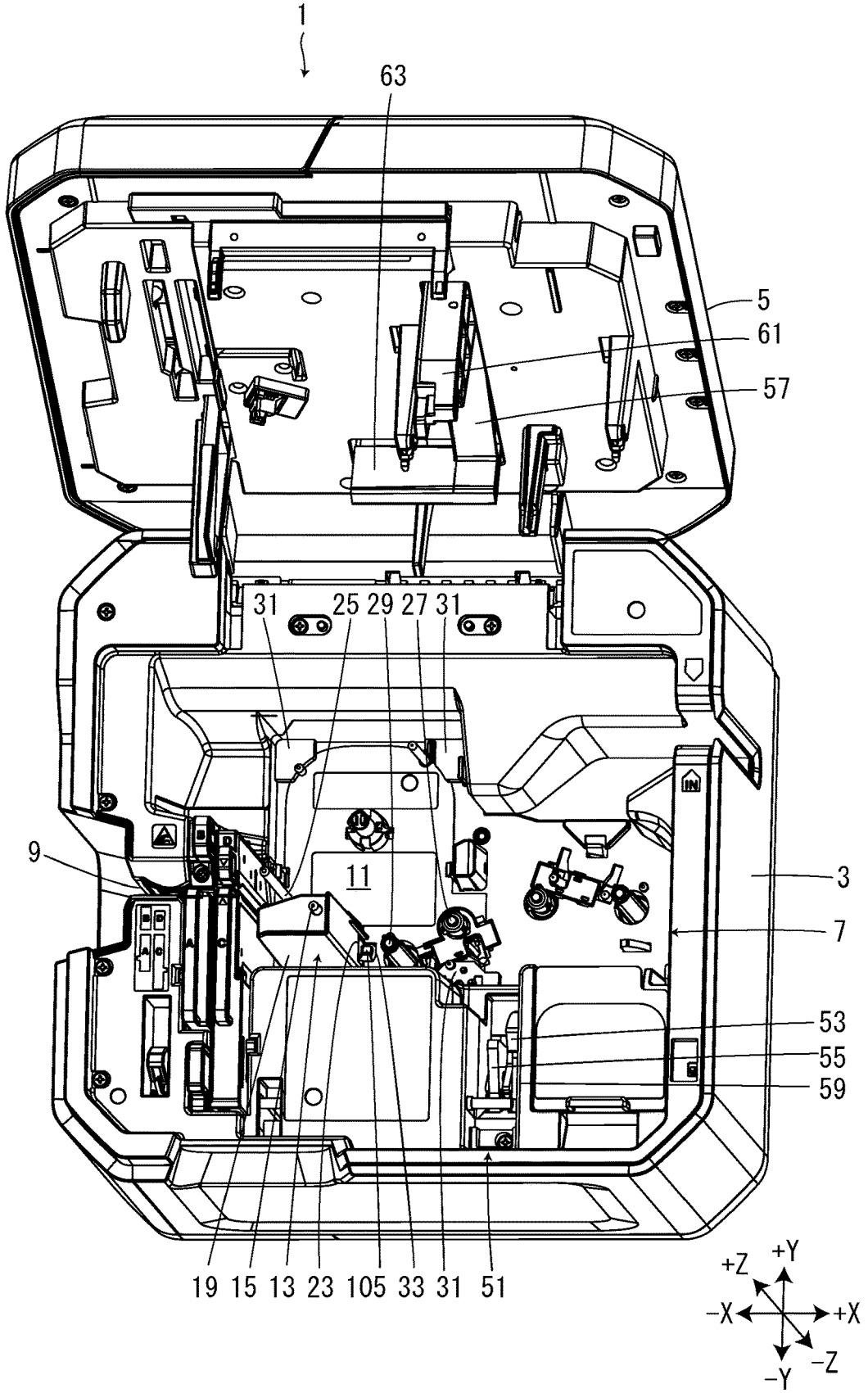
FIG. 1 is a perspective view of a tape printing apparatus.
Figure 2:
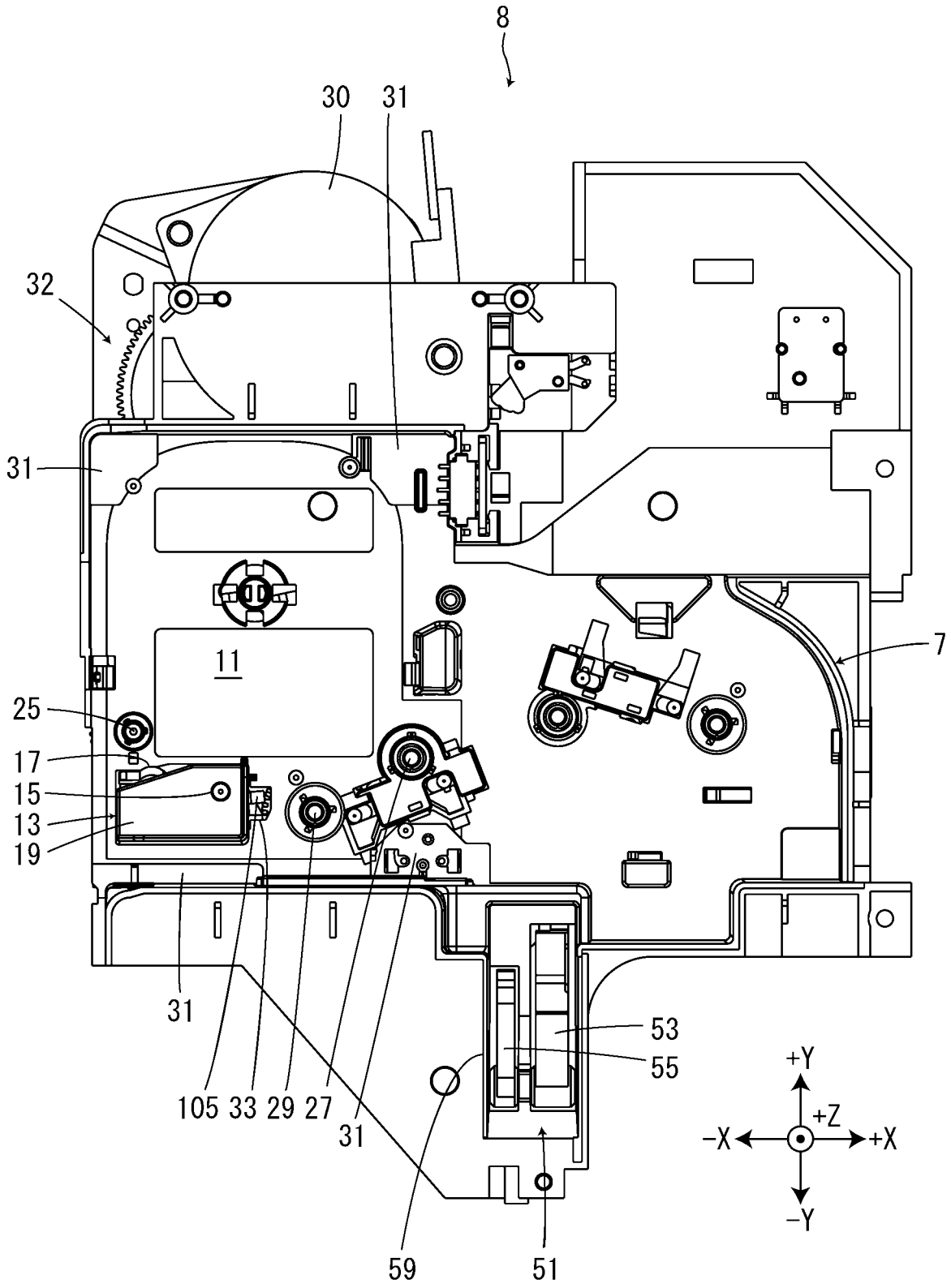
FIG. 2 is a diagram of the apparatus body in which the tape cartridge has been removed, viewed from a direction opposite a mounting direction.
Figure 3:
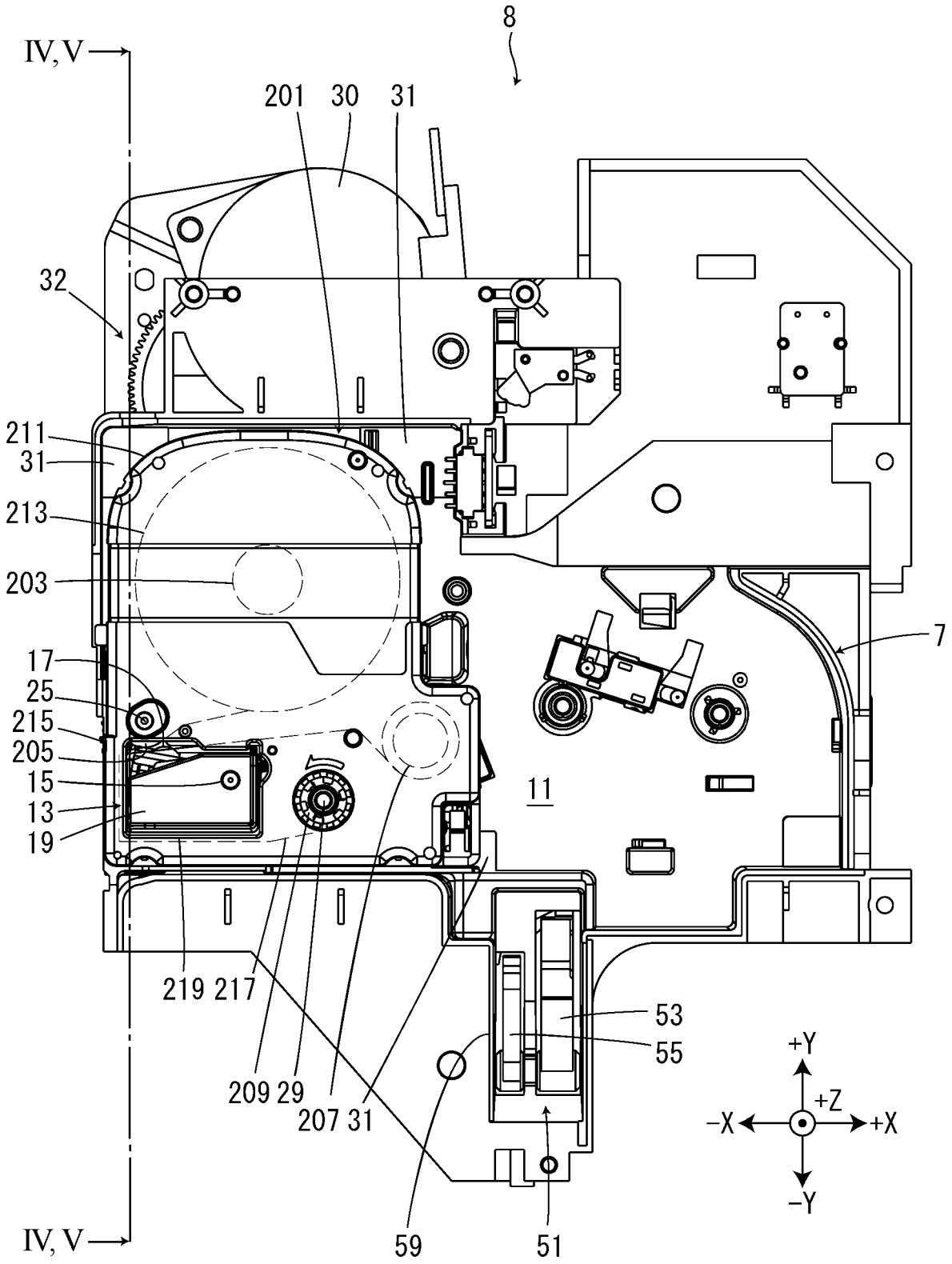
FIG. 3 is a diagram of the apparatus body in which the tape cartridge has been mounted, viewed from the direction opposite the mounting direction.

As illustrated in FIGS. 1 to 3, a tape printing apparatus 1 includes an apparatus case 3 and a mounting portion lid 5. The apparatus case 3 is formed in a substantially rectangular parallelepiped shape. A cartridge mounting portion 7 is provided on a surface of the apparatus case 3 on the +Z side. An apparatus body 8 (see FIGS. 2 and 3) including the cartridge mounting portion 7 is installed in the apparatus case 3.

A tape cartridge 201 is mounted on the cartridge mounting portion 7 in a detachable manner. A tape discharge port 9 is provided in a surface of the apparatus case 3 on the −X side. Tape 213 sent out from the tape cartridge 201 mounted on the cartridge mounting portion 7 is discharged through the tape discharge port 9.

The mounting portion lid 5 opens/closes the cartridge mounting portion 7. The mounting portion lid 5 is pivotably attached to an end portion of the apparatus case 3 on the +Y side. Note that while not illustrated in the drawings, a keyboard and a display are provided inside the mounting portion lid 5. The keyboard receives input operations including print information such as character strings and the like, and various instructions such as printing. The display displays various information in addition to the print information input through the keyboard.

The cartridge mounting portion 7 is formed in a recessed shape in which the +Z side is open. A head portion 13 is provided on a mounting bottom surface 11 that is a bottom surface of the cartridge mounting portion 7. The head portion 13 includes a head shaft 15, a thermal head 17, and a head cover 19.

The head shaft 15 extends in the Z direction and pivotably supports the thermal head 17. The head shaft 15 is cantilevered and supported by a base frame 21 built-in on the −Z side of the cartridge mounting portion 7 (see FIGS. 8 and 9).

The head cover 19 covers a portion of the thermal head 17. When the tape cartridge 201 is mounted on the cartridge mounting portion 7, the head cover 19, together with a platen shaft 25 described later, guides the mounting of the tape cartridge 201. A cover-side switching opening 23 is provided in a wall portion of the head cover 19 on the +X side and at an end portion in a mounting direction. A pushing protrusion 105 of a pressurizing position switching portion 69 described later protrudes from the cover-side switching opening 23 to the +X side.

Furthermore, the platen shaft 25, a paying out shaft 27, and a winding shaft 29 are provided on the mounting bottom surface 11. The platen shaft 25, the paying out shaft 27, and the winding shaft 29 extend in the Z direction and are cantilevered and supported by the base frame 21 (see FIGS. 8 and 9).

The platen shaft 25 is provided on the +Y side of the thermal head 17. Compared with the paying out shaft 27 and the winding shaft 29, an amount in which the platen shaft 25 protrudes to the +Z side is large. When the tape cartridge 201 is mounted on the cartridge mounting portion 7, the platen shaft 25 is inserted through a platen roller 205 housed in the tape cartridge 201 and guides the mounting of the tape cartridge 201. Note that hereinafter, the mounting direction of the tape cartridge 201 is merely referred to as a "mounting direction". The mounting direction is parallel to a direction in which the platen shaft 25 extends, in other words, is parallel to the Z direction. Furthermore, a direction opposite the mounting direction denotes the +Z side, and the mounting direction denotes the −Z side.

Four mount protrusions 31 are provided at a peripheral portion of the mounting bottom surface 11. The tape cartridge 201 is mounted on the cartridge mounting portion 7 by being mounted on the four mount protrusions 31.

Continuous to the cover-side switching opening 23 provided in the head cover 19, a bottom surface-side switching opening 33 is provided in the mounting bottom surface 11. The pushing protrusion 105 of the pressurizing position switching portion 69 moves in and out in the mounting direction through the bottom surface-side switching opening 33.

As illustrated in FIG. 3, the tape cartridge 201 includes a tape core 203, the platen roller 205, a paying out core 207, a winding core 209, and a cartridge case 211 that houses the above. The tape 213 is wound around the tape core 203. The tape 213 sent out from the tape core 203 is sent out to the outside of the cartridge case 211 through a tape paying out port 215 provided in a wall portion of the cartridge case 211 on the −X side. An ink ribbon 217 is wound around the paying out core 207. The ink ribbon 217 sent out from the paying out core 207 is wound by the winding core 209. A head insertion hole 219 penetrating in the mounting direction is provided in the cartridge case 211.

When the tape cartridge 201 is mounted on the cartridge mounting portion 7, the head portion 13, the platen shaft 25, the paying out shaft 27, and the winding shaft 29 are inserted in the head insertion hole 219, the platen roller 205, the paying out core 207, and the winding core 209, respectively. The platen shaft 25, the paying out shaft 27, and the winding shaft 29 rotatably support the platen roller 205, the paying out core 207, and the winding core 209, respectively. Rotation of a feed motor 30 is transmitted to the platen roller 205, the paying out core 207, and the winding core 209 through a feed gear train 32.

Figure 8:
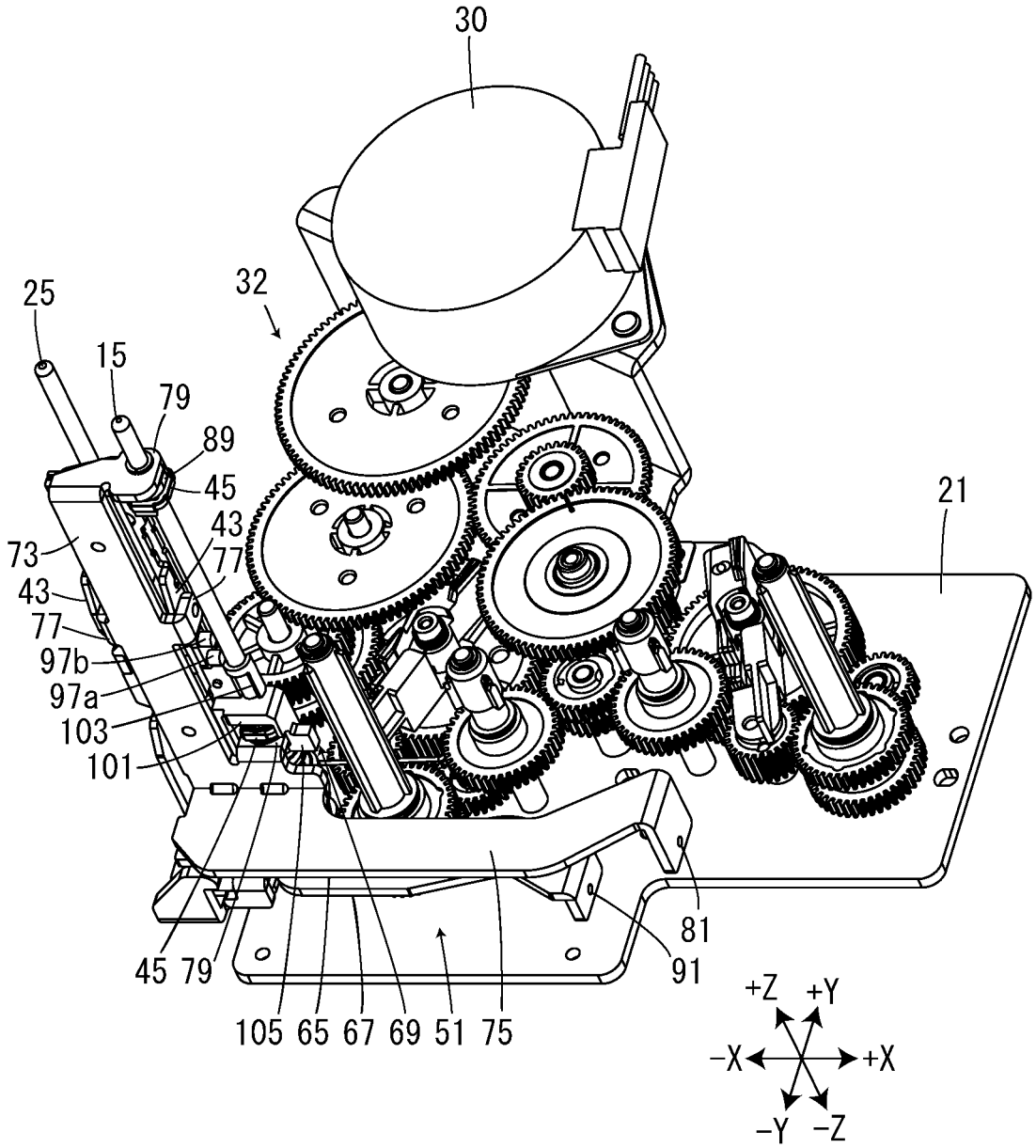
FIG. 8 is a perspective view of the head pressurizing mechanism.
Figure 9:
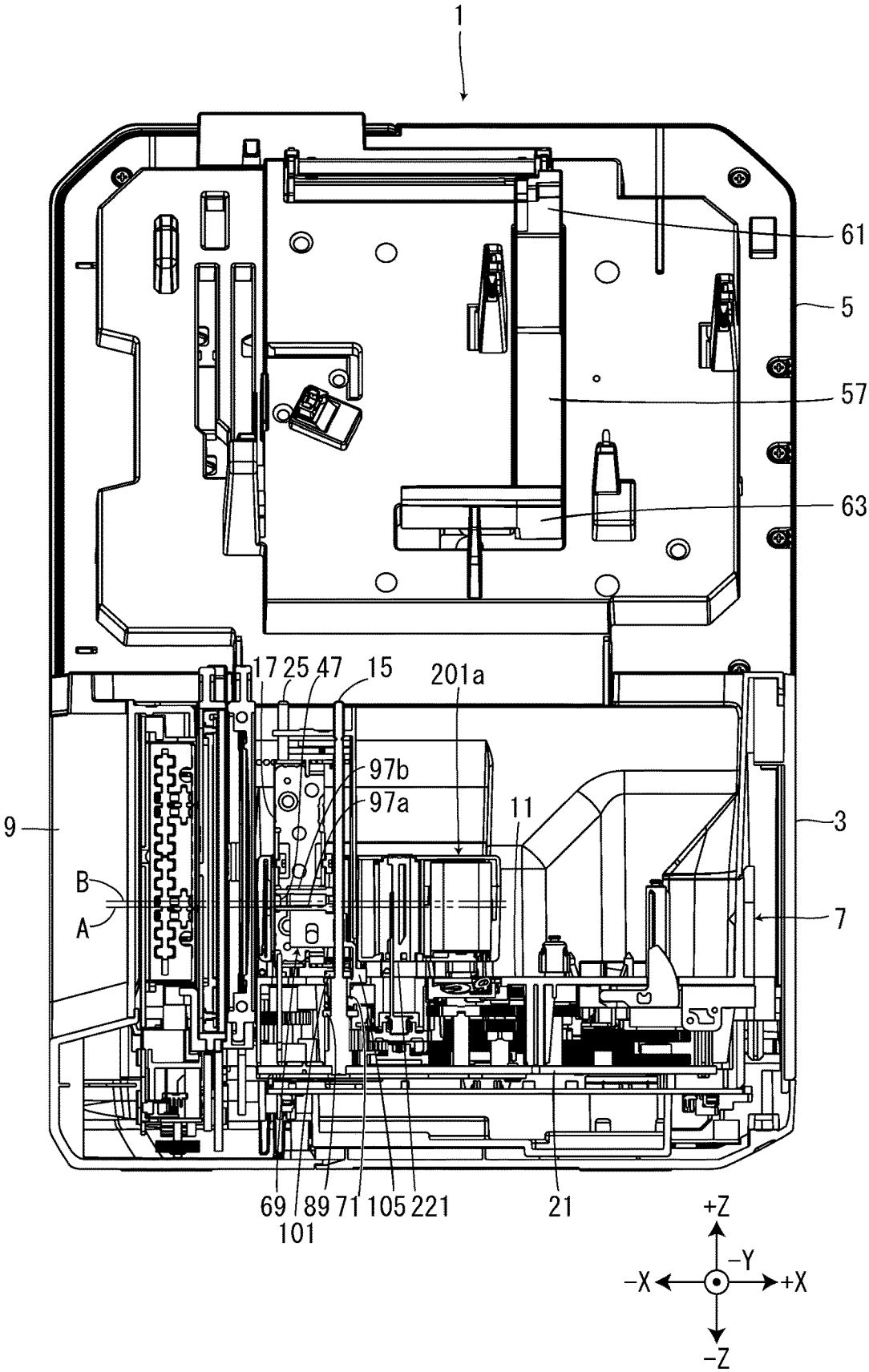
FIG. 9 is a cross-sectional view of the tape printing apparatus, in which the first tape cartridge is mounted, viewed from the −Y side.

When the mounting portion lid 5 is closed after the tape cartridge 201 has been mounted on the cartridge mounting portion 7, the thermal head 17 is pressed against the platen roller 205 with a head pressurizing mechanism 51 (see FIG. 8). With the above, the tape 213 and the ink ribbon 217 are pinched between the thermal head 17 and the platen roller 205. When the platen roller 205 rotates in the above state, the tape 213 and the ink ribbon 217 are fed. In so doing, by having the thermal head 17 generate heat, print information input through a keyboard or the like is printed on the tape 213.

Types of Tape Cartridge

A first tape cartridge 201*a* (see FIG. 4), and a second tape cartridge 201*b* (see FIG. 5), in which tape 213 having a width that is wider than that of the first tape cartridge 201*a* is accommodated, are prepared as the tape cartridge 201. A width of the tape 213 accommodated in the first tape cartridge 201*a* is, for example, no less than 4 mm and less than 36 mm, and a width of the tape 213 accommodated in the second tape cartridge 201*b* is, for example, no less than 36 mm and less than 50 mm.

Figure 4:
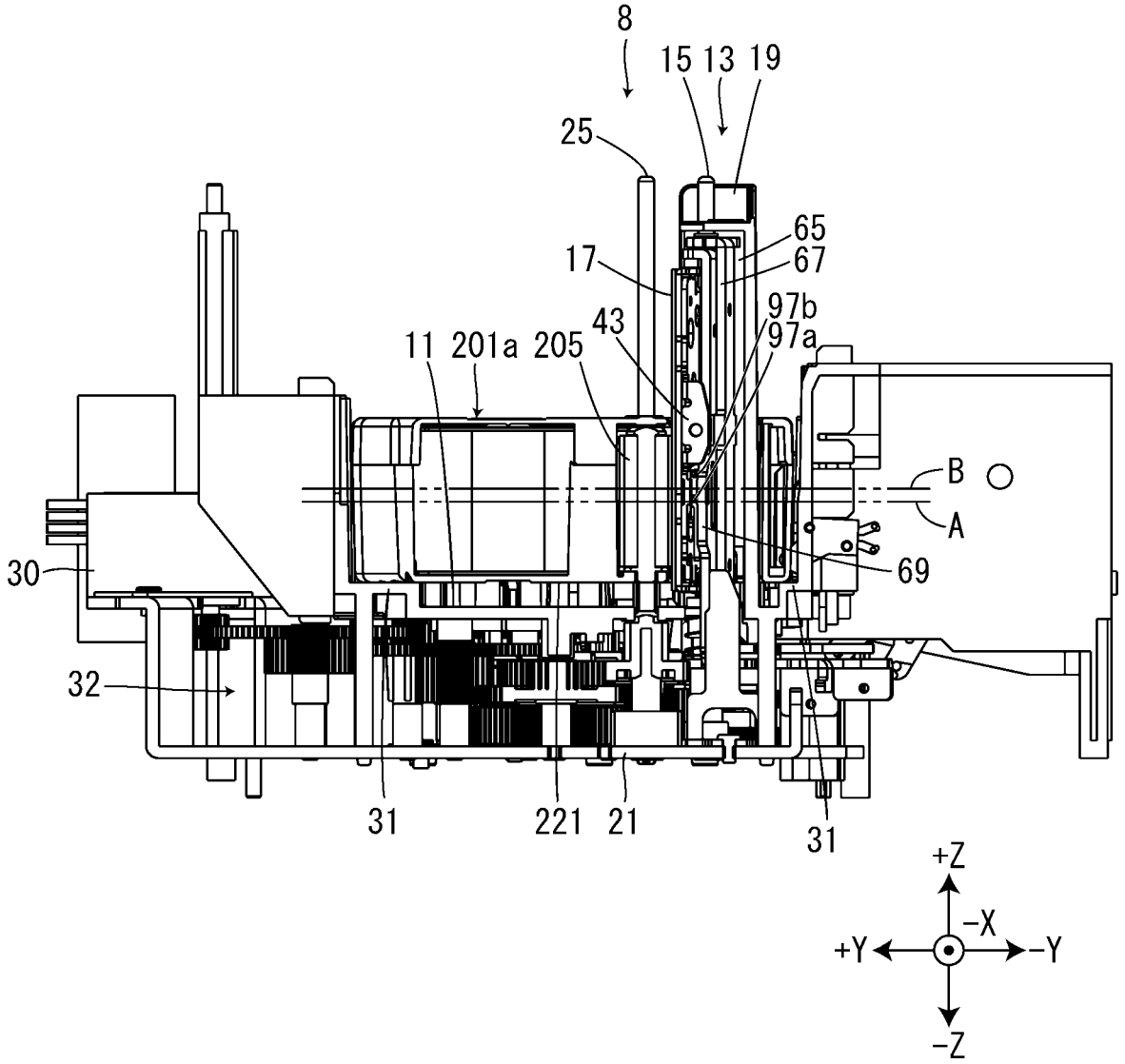
FIG. 4 is a cross-sectional view of the apparatus body, on which a first tape cartridge has been mounted, cut along line IV-IV in FIG. 3.

As illustrated in FIG. 4, when the first tape cartridge 201*a* is mounted on the cartridge mounting portion 7, as described above, the first tape cartridge 201*a* is mounted on the four mount protrusions 31. Accordingly, a gap having a height that is substantially the same as that of each mount protrusion 31 is created between a bottom wall surface 221, which is a wall surface of the cartridge case 211 in the mounting direction, and the mounting bottom surface 11 of the cartridge mounting portion 7.

Figure 5:
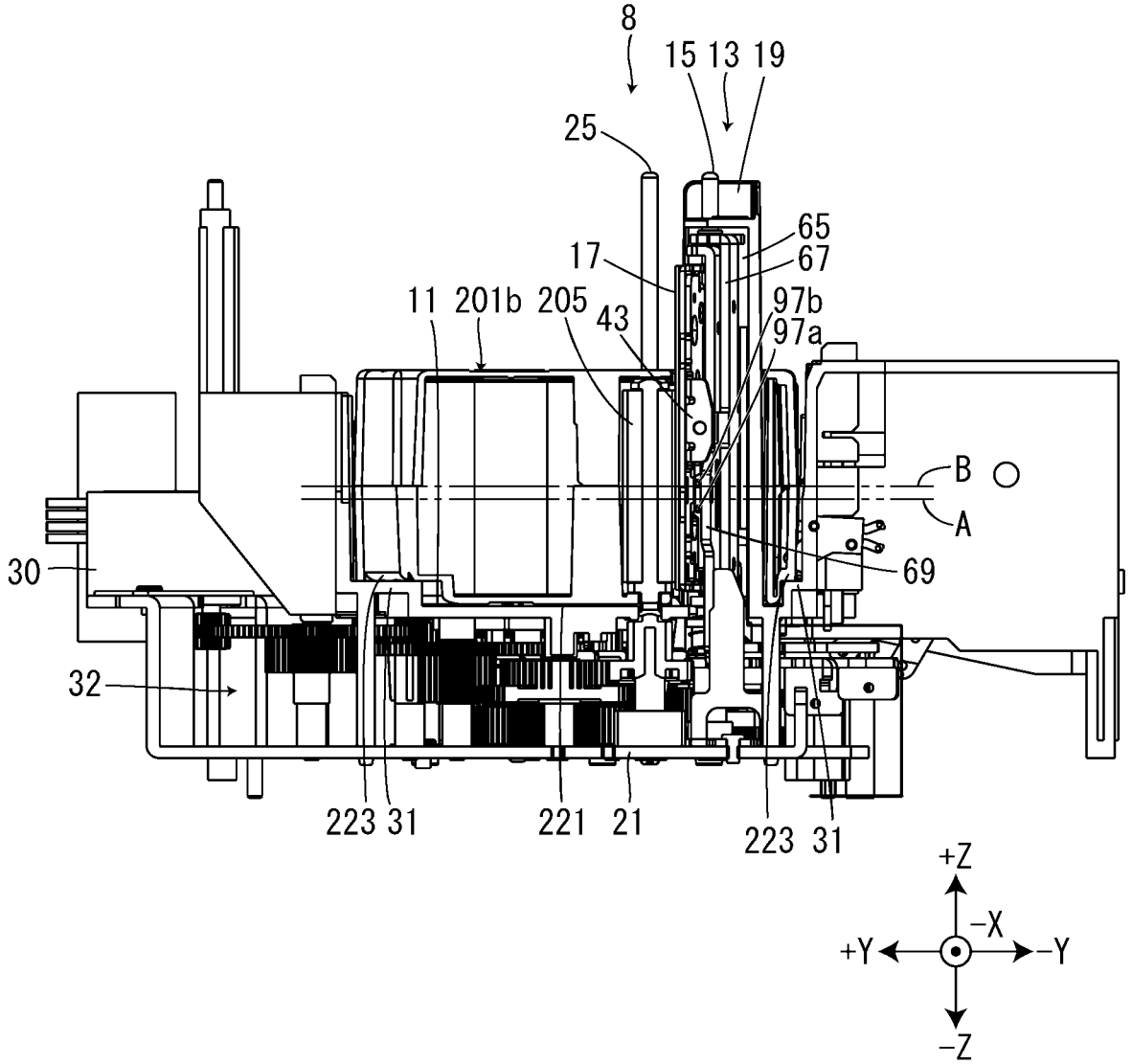
FIG. 5 is a cross-sectional view of the apparatus body, on which a second tape cartridge has been mounted, cut along line V-V in FIG. 3.

In contrast, as illustrated in FIG. 5, four mount recesses 223 corresponding to the four mount protrusions 31 are provided in a peripheral portion of the bottom wall surface 221 of the second tape cartridge 201*b*. Accordingly, when the second tape cartridge 201*b* is mounted on the cartridge mounting portion 7, the mount protrusions 31 enter the mount recesses 223 so that the mounting bottom surface 11 and the bottom wall surface 221 are in close proximity to each other.

Note that while not illustrated in the drawings, a third tape cartridge in which tape 213 having a width that is wider than that of the second tape cartridge 201*b* is accommodated is, in addition to the first tape cartridge 201*a* and the second tape cartridge 201*b*, prepared as the tape cartridge 201. A width of the tape 213 accommodated in the third tape cartridge is, for example, no less than 50 mm.

Note that a first imaginary line A illustrated in FIGS. 4 and 5 is a line that passes through a width-direction middle portion of the tape 213 accommodated in the first tape cartridge 201*a*, and a second imaginary line B is a line that passes through a width-direction middle portion of the tape 213 accommodated in the second tape cartridge 201*b*. The second imaginary line B is, with respect to the first imaginary line A, located in the direction opposite the mounting direction. Note that the width-direction middle portion of the tape 213 in either the first tape cartridge 201*a* and the second tape cartridge 201*b* substantially coincides with the middle portion of the platen roller 205 in the mounting direction.

Figure 10:
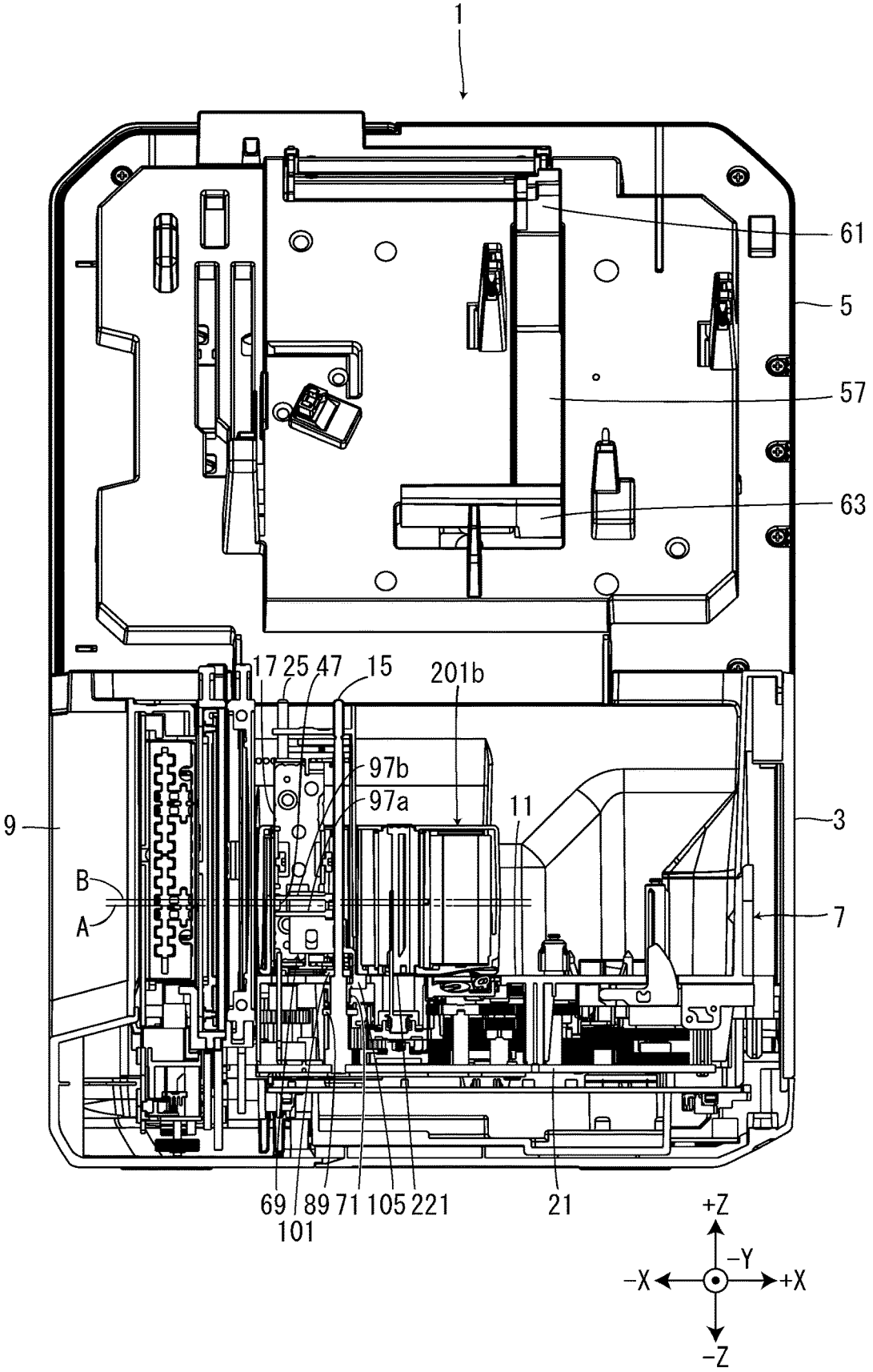
FIG. 10 is a cross-sectional view of the tape printing apparatus, in which the second tape cartridge is mounted, viewed from the −Y side.

As described above, the location of the middle portion of the tape 213 in the width direction is different in the first tape cartridge 201*a* and in the second tape cartridge 201*b*, when the first tape cartridge 201*a* and the second tape cartridge 201*b* are mounted on the cartridge mounting portion 7. Desirably, the center of the pressure applied to the tape 213 with the thermal head 17 is substantially the middle portion of the tape 213 in the width direction. Accordingly, while details will be described later, the tape printing apparatus 1 includes the pressurizing position switching portion 69 (see FIGS. 9 and 10) configured to switch the position where the pressure is applied to the thermal head 17 so that the pressure is applied to the tape 213 at the substantially width-direction middle portion of the tape 213 with the thermal head 17 when either of the first tape cartridge 201*a* and the second tape cartridge 201*b* is mounted.

Thermal Head

Figure 6:
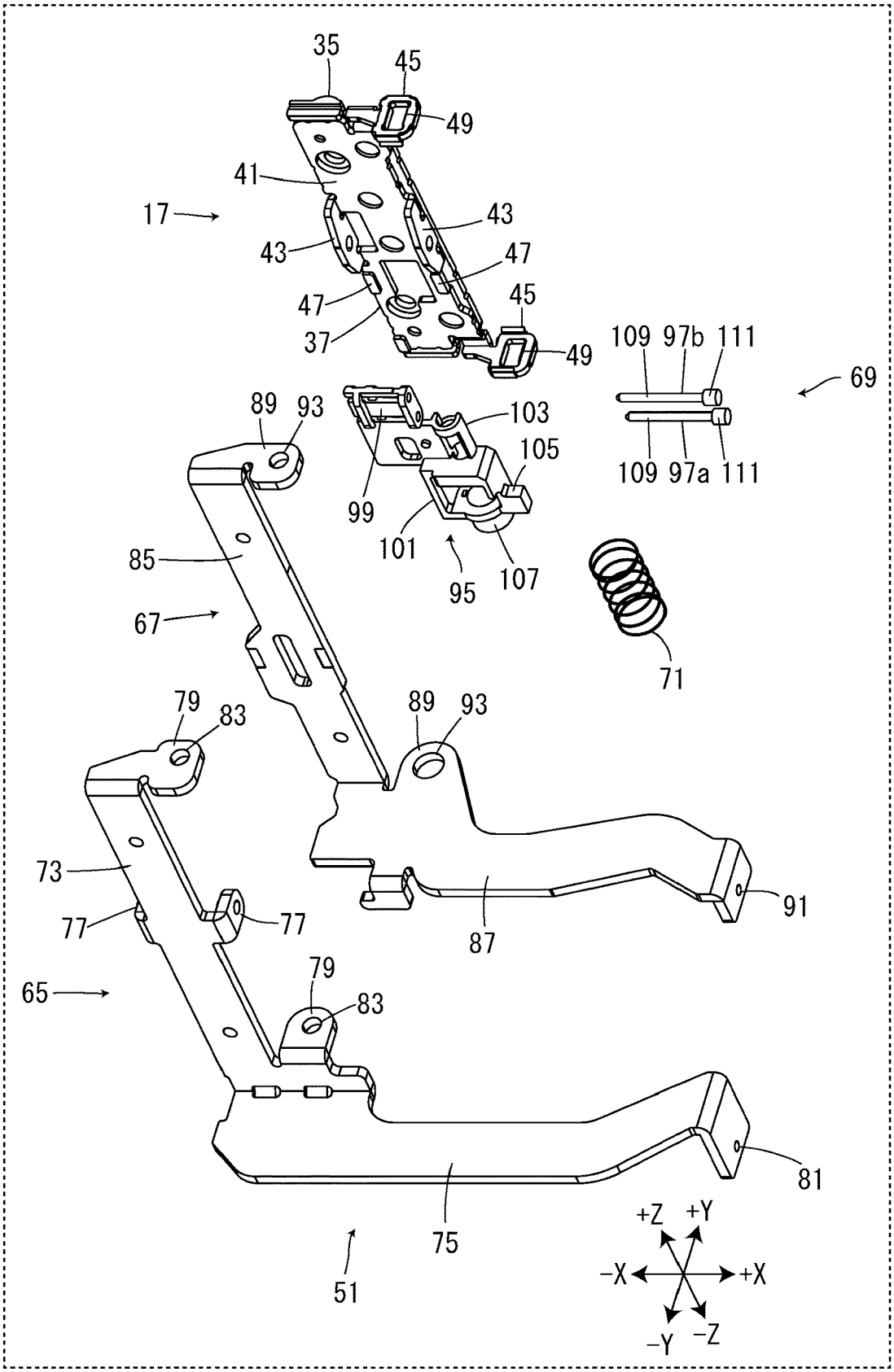
FIG. 6 is an exploded perspective view of a thermal head and a head pressurizing mechanism.
Figure 7:
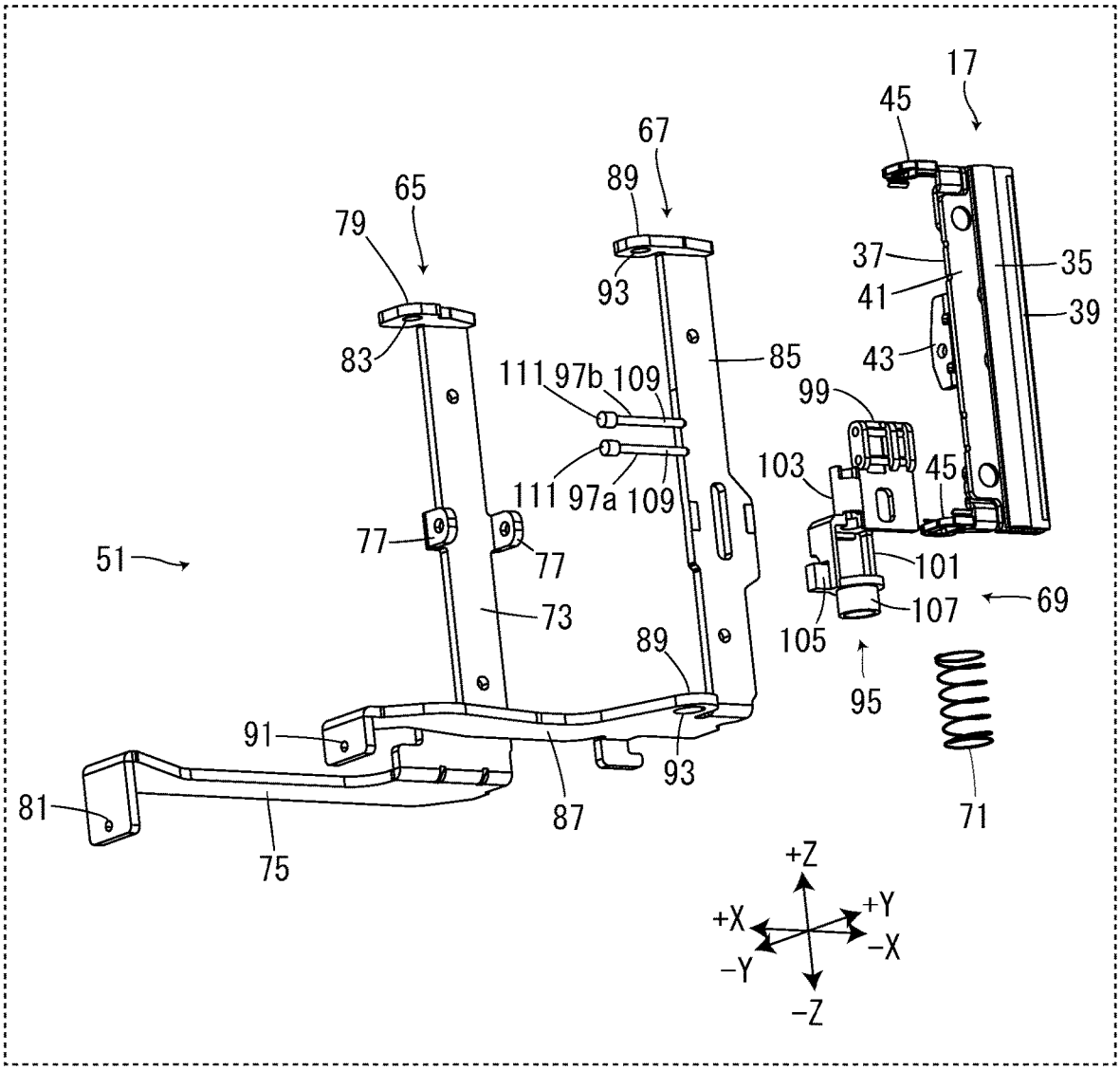
FIG. 7 is an exploded perspective view of the thermal head and the head pressurizing mechanism viewed from an angle different from that of FIG. 6.

As illustrated in FIGS. 6 and 7, the thermal head 17 includes a head body 35 and a head holder 37.

The head body 35 is formed in a substantially rectangular plate shape long in the mounting direction. A heating portion 39 is provided on a surface of the head body 35 on the +Y side and at an end portion on the −X side. A plurality of heating elements arranged in the mounting direction or in the width direction of the tape 213 are provided in the heating portion 39.

The head holder 37 holds the head body 35. The head holder 37 is supported so as to be, relative to the head shaft 15, pivotable about the head shaft 15. The head holder 37 includes a holder body 41, two holder-side connection portions 43, and two holder shaft insertion portions 45.

The holder body 41 is formed in a substantially rectangular plate shape long in the mounting direction. The head body 35 is fixed to a surface of the holder body 41 on the +Y side. Two pressure receiving portions 47 protruding towards the −Y side are provided on a surface of the holder body 41 on the −Y side. In other words, the two pressure receiving portions 47 are provided on the side of the thermal head 17 opposite the platen roller 205. The two pressure receiving portions 47 are located on the mounting direction side with respect to the two holder-side connection portions 43, and are away from each other in the X direction. The two pressure receiving portions 47 are provided at positions corresponding to the first imaginary line A and the second imaginary line B (see FIGS. 9 and 10). In other words, the two pressure receiving portions 47 are provided at positions corresponding to the width-direction middle portion of the tape 213 accommodated in the first tape cartridge 201*a* and the width-direction middle portion of the tape 213 accommodated in the second tape cartridge 201*b*.

The two holder-side connection portions 43 are provided so as to protrude towards the −Y side from an end portion on the +X side and an end portion on the −X side at substantially the middle portion of the holder body 41 in the mounting direction. The two holder-side connection portions 43 are coupled to the two frame-side connection portions 77 described later so as to be pivotable about an axis parallel to the X-axis.

The two holder shaft insertion portions 45 are provided at an end portion of the holder body 41 in the direction opposite the mounting direction and an end portion of the holder body 41 in the mounting direction, and are located on the +X side with respect to the holder body 41. Holder shaft holes 49 are provided in the holder shaft insertion portions 45. The head shaft 15 is inserted in the holder shaft holes 49.

Head Pressure Applying Mechanism

The head pressurizing mechanism 51 presses the thermal head 17 against the platen roller 205 accommodated in the tape cartridge 201 mounted on the cartridge mounting portion 7. As illustrated in FIG. 1, the head pressurizing mechanism 51 includes a support frame actuation lever 53, a pressurizing frame actuation lever 55, and a head pressurizing rib 57.

The support frame actuation lever 53 is accommodated in a lever accommodation portion 59 provided on the −Y side of the cartridge mounting portion 7. The support frame actuation lever 53 is coupled to a head support frame 65 (see FIG. 8) described later through a support frame spring (not shown). The support frame actuation lever 53 is pivotably supported about an axis parallel to the X-axis. An end portion of the support frame spring on the −Y side is latched to an end portion of the support frame actuation lever 53 in the mounting direction. Note that a tension coil spring, for example, can be used as the support frame spring.

The pressurizing frame actuation lever 55 is accommodated in the lever accommodation portion 59 together with the support frame actuation lever 53. The pressurizing frame actuation lever 55 is provided on the −X side of the support frame actuation lever 53. The pressurizing frame actuation lever 55 is coupled to the head pressurizing frame (see FIG. 8) described later through the pressurizing frame spring (not shown). The pressurizing frame actuation lever 55 is pivotably supported about an axis parallel to the X-axis. An end portion of the pressurizing frame spring on the −Y side is latched to an end portion of the pressurizing frame actuation lever 55 in the mounting direction. Note that a tension coil spring, for example, can be used as the pressurizing frame spring.

The head pressurizing rib 57 is supported so as to be, relative to the mounting portion lib 5, pivotable about an axis parallel to the X-axis. When the mounting portion lib 5 is closed, the head pressurizing rib 57 pivots either one of the support frame actuation lever 53 and the pressurizing frame actuation lever 55 according to the type of tape cartridge 201 mounted on the cartridge mounting portion 7. The head pressurizing rib 57 includes a lever-side engagement portion 61 provided at an end portion on the −Y side, and a cartridge-side engagement portion 63 provided at an end portion on the +Y side. Note that the Y direction referred to in the head pressurizing rib 57 denotes the Y direction when the mounting portion lib 5 is in a closed state.

In a state in which the first tape cartridge 201*a* or the second tape cartridge 201*b* is mounted on the cartridge mounting portion 7, the cartridge-side engagement portion 63 does not engage with the first tape cartridge 201*a* or the second tape cartridge 201*b* in the course of closing the mounting portion lib 5; accordingly, the head pressurizing rib 57 does not pivot relative to the mounting portion lib 5. Accordingly, when the mounting portion lib 5 is closed, the lever-side engagement portion 61 engages with, among the support frame actuation lever 53 and the pressurizing frame actuation lever 55, the pressurizing frame actuation lever 55. With the above, when viewed from the −X side, the pressurizing frame actuation lever 55 pivots counterclockwise, and the pressurizing frame spring is pulled towards the −Y side.

On the other hand, in a state in which the third tape cartridge is mounted on the cartridge mounting portion 7, the cartridge-side engagement portion 63 engages with the third tape cartridge in the course of closing the mounting portion lib 5, and the head pressurizing rib 57 pivots relative to the mounting portion lib 5. Accordingly, when the mounting portion lid 5 is closed, the lever-side engagement portion 61 engages with, among the support frame actuation lever 53 and the pressurizing frame actuation lever 55, the support frame actuation lever 53. With the above, when viewed from the −X side, the support frame actuation lever 53 pivots counterclockwise, and the support frame spring is pulled towards the −Y side.

Furthermore, as illustrated in FIGS. 6 to 8, the head pressurizing mechanism 51 includes the head support frame 65, the head pressurizing frame 67, the pressurizing position switching portion 69, and a pressurizing position switching spring 71.

The head support frame 65 supports the thermal head 17. The head support frame 65 is supported so as to be, relative to the head shaft 15, pivotable about the head shaft 15. The head support frame 65 includes a first support frame portion 73, a second support frame portion 75, the two frame-side connection portions 77, and two support frame shaft insertion portions 79.

The first support frame portion 73 is provided on the −Y side of the holder body 41. The first support frame portion 73 is formed in a substantially rectangular plate shape long in the mounting direction.

The second support frame portion 75 extends towards the +X side from an end portion of the first support frame portion 73 in the mounting direction. A support frame spring latch portion 81 is provided at an end portion of the second support frame portion 75 on the +X side. An end portion of the support frame spring on the +Y side is latched to the support frame spring latch portion 81.

The two frame-side connection portions 77 are provided at a substantially middle portion of the first support frame portion 73 in the mounting direction so as to protrude towards the +Y side from an end portion on the +X side and an end portion on the −X side. The two holder-side connection portions 43 are coupled to the two frame-side connection portions 77 so as to be pivotable about an axis parallel to the X-axis.

The two support frame shaft insertion portions 79 are provided at an end portion of the first support frame portion 73 in the direction opposite the mounting direction and at an end portion of the first support frame portion 73 in the mounting direction, and are located on the +X side with respect to the first support frame portion 73. Support shaft holes 83 are provided in the support frame shaft insertion portions 79. The head shaft 15 is inserted through the support shaft holes 83.

When the mounting portion lib 5 is closed while in a state in which the third tape cartridge is mounted on the cartridge mounting portion 7, the support frame actuation lever 53 pivots and the support frame spring is pulled towards the −Y side; accordingly, the head support frame 65 configured in the above manner pivots clockwise when viewed in the direction opposite the mounting direction and presses the thermal head 17, which has been supported, against the platen roller 205.

When the first tape cartridge 201*a* or the second tape cartridge 201*b* is mounted on the cartridge mounting portion 7, the head pressurizing frame 67 presses the thermal head 17 against the platen roller 205 through the pressurizing position switching portion 69. The head pressurizing frame 67 is an example of a "pressurizing portion". The head pressurizing frame 67 is supported so as to be, relative to the head shaft 15, pivotable about the head shaft 15. The head pressurizing frame 67 includes a first pressurizing frame portion 85, a second pressurizing frame portion 87, and two pressurizing frame shaft insertion portions 89.

The first pressurizing frame portion 85 is provided between the holder body 41 and the first support frame portion 73. The first pressurizing frame portion 85 is formed in a substantially rectangular plate shape long in the mounting direction.

The second pressurizing frame portion 87 extends towards the +X side from an end portion of the first pressurizing frame portion 85 in the mounting direction. A pressurizing frame spring latch portion 91 is provided at an end portion of the second pressurizing frame portion 87 on the +X side. An end portion of the pressurizing frame spring on the +Y side is latched to the pressurizing frame spring latch portion 91.

The two pressurizing frame shaft insertion portions 89 are provided at an end portion of the first pressurizing frame portion 85 in the direction opposite the mounting direction and at an end portion of the first pressurizing frame portion 85 in the mounting direction, and are located on the +X side with respect to the first pressurizing frame portion 85. Pressurizing shaft holes 93 are provided in the pressurizing frame shaft insertion portions 89. The head shaft 15 is inserted through the pressurizing shaft holes 93.

When the mounting portion lib 5 is closed while in a state in which the first tape cartridge 201*a* or the second tape cartridge 201*b* is mounted on the cartridge mounting portion 7, the pressurizing frame actuation lever 55 pivots and the pressurizing frame spring is pulled towards the −Y side; accordingly, the head pressurizing frame 67 configured in the above manner pivots clockwise when viewed in the direction opposite the mounting direction and presses the thermal head 17 against the platen roller 205 through the pressurizing position switching portion 69.

Note that counterclockwise force when viewed in the direction opposite the mounting direction is applied to the head pressurizing frame 67 with, for example, a torsion coil spring (not shown) provided in the head shaft 15. Accordingly, when the mounting portion lid 5 is opened, the head pressurizing frame 67 pivots counterclockwise when viewed in the direction opposite the mounting direction. With the above, the head support frame 65 is pushed by the head pressurizing frame 67 and pivots counterclockwise when viewed in the direction opposite the mounting direction, and the thermal head 17 supported by the head support frame 65 is separated from the platen roller 205.

The pressurizing position switching portion 69 is a member that switches the position where the pressure is applied to the thermal head 17 between when the first tape cartridge 201*a* is mounted and when the second tape cartridge 201*b* is mounted. The pressurizing position switching portion 69 is provided between the holder body 41 and the first pressurizing frame portion 85. In other words, the pressurizing position switching portion 69 is provided on a side opposite the platen roller 205 with respect to the thermal head 17. The pressurizing position switching portion 69 includes a pin holder 95 and two contact pins 97.

The pin holder 95 holds the two contact pins 97. The pin holder 95 is supported so as to be, relative to the head shaft 15, pivotable about the head shaft 15 and moveable in the mounting direction. The pin holder 95 includes a pin holding portion 99, a switching spring receiving portion 101, a switching guide portion 103, and the pushing protrusion 105. The pin holder 95 is an example of a "holder".

The two contact pins 97 are held in the pin holding portion 99 so as to be separated from each other in the mounting direction. In the pin holding portion 99, each of the contact pin 97 is held in a position extending in the X direction.

The switching spring receiving portion 101 is provided on the mounting direction side and on the +X side of the pin holding portion 99, and is formed in a substantially rectangular parallelepiped shape in which the +Y side and the −Y side are open. A short and substantially cylindrical switching spring mounting portion 107 is provided on the mounting direction side of the switching spring receiving portion 101. The switching spring mounting portion 107 is inserted in an end portion of the pressurizing position switching spring 71 in the direction opposite the mounting direction. Force in the direction opposite the mounting direction is applied to the switching spring receiving portion 101 with the pressurizing position switching spring 71. The holder shaft insertion portion 45 in the mounting direction enters the switching spring receiving portion 101 from the +Y side, and the support frame shaft insertion portion 79 in the mounting direction enters the switching spring receiving portion 101 from the −Y side.

The switching guide portion 103 is, with respect to the switching spring receiving portion 101, provided in the direction opposite the mounting direction. The switching guide portion 103 is formed in a substantially cylindrical shape. The switching guide portion 103 guides the pin holder 95 to move in the mounting direction along the head shaft 15 that has penetrated through the switching guide portion 103, the switching spring receiving portion 101, and the switching spring mounting portion 107.

The pushing protrusion 105 is provided so as to protrude towards the +X side from a wall portion of the switching spring receiving portion 101 on the +X side. The pushing protrusion 105 is a portion that is pushed in the mounting direction by the second tape cartridge 201*b* when the second tape cartridge 201*b* is mounted on the cartridge mounting portion 7. The pushing protrusion 105 is an example of a "pushing protrusion".

When the head pressurizing frame 67 is pivoted clockwise when viewed in the direction opposite the mounting direction, the pin holder 95 is pushed by the head pressurizing frame 67 and is pivoted clockwise when viewed in the direction opposite the mounting direction, in other words, is pivoted towards the thermal head 17. With the above, one of the two contact pins 97 held in the pin holder 95 comes in contact with the pressure receiving portions 47.

The two contact pins 97 are held in the pin holding portion 99 so as to be separated from each other in the mounting direction. Between the two contact pins 97, the contact pin 97 in the mounting direction is referred to as a first contact pin 97*a*, and the contact pin 97 in the direction opposite the mounting direction is referred to as a second contact pin 97*b*. The first contact pin 97*a* is an example of a "first contact portion", and the second contact pin 97*b* is an example of a "second contact portion". The contact pin 97 includes a body portion 109 formed in a substantially cylindrical shape extending in the X direction, and a head portion 111 provided at an end portion of the body portion 109 on the +X side. When the contact pin 97 comes in contact with the pressure receiving portions 47, an end portion of the body portion 109 on the −X side comes in contact with the pressure receiving portion 47 on the −X side, and the end portion of the body portion 109 on the +X side comes in contact with the pressure receiving portion 47 on the +X side.

The pressurizing position switching spring 71 applies force to the switching spring receiving portion 101 of the pin holder 95 in the direction opposite the mounting direction. The pressurizing position switching spring 71 is provided between the switching spring receiving portion 101, and the pressurizing frame shaft insertion portion 89 in the mounting direction, which is provided on the mounting direction side of the switching spring receiving portion 101 (see FIG. 9). Note that a compression spring, for example, can be used as the pressurizing position switching spring 71. The pressurizing position switching spring 71 is an example of an "elastic member".

Note that the pressurizing position switching portion 69 moves between a first switching position (see FIG. 9) and a second switching position (see FIG. 10) that is in the mounting direction with respect to the first switching position. When the pressurizing position switching portion 69 is positioned at the first switching position, the first contact pin 97*a* is, in the mounting direction, positioned at substantially the same position as that of the first imaginary line A, in other words, at the width-direction middle portion of the tape 213 accommodated in the first tape cartridge 201*a*. On the other hand, when the pressurizing position switching portion 69 is positioned at the second switching position, the second contact pin 97*b* is, in the mounting direction, positioned at substantially the same position as that of the second imaginary line B, in other words, at the width-direction middle portion of the tape 213 accommodated in the second tape cartridge 201*b*.

Since force in the direction opposite the mounting direction is applied to the pressurizing position switching portion 69 with the pressurizing position switching spring 71, when neither of the tape cartridges 201 are mounted on the cartridge mounting portion 7, the pressurizing position switching portion 69 is positioned at the first switching position.

As described above, a gap is created between the mounting bottom surface 11 and the bottom wall surface 221 when the first tape cartridge 201*a* is mounted (see FIG. 4). Accordingly, the pressurizing position switching portion 69 remains positioned at the first switching position without the pushing protrusion 105 protruding from the mounting bottom surface 11 in the direction opposite the mounting direction being pushed by the first tape cartridge 201*a* in the mounting direction (see FIG. 9). In the above state, when the mounting portion lid 5 is closed and the pressurizing position switching portion 69 pushed by the head pressurizing frame 67 pivots towards the thermal head 17, the first contact pin 97*a*, between the two contact pins 97, comes in contact with the pressure receiving portions 47 of the head holder 37. With the above, the first contact pin 97*a* becomes the position where pressure is applied to the thermal head 17.

When the pressurizing position switching portion 69 is positioned at the first switching position, as described above, the first contact pin 97*a* is, in the mounting direction, positioned at substantially the same position as that of the width-direction middle portion of the tape 213 accommodated in the first tape cartridge 201*a*. Accordingly, when the first tape cartridge 201*a* is mounted, the center of the pressure applied to the tape 213 pinched between the thermal head 17 and the platen roller 205 is substantially the middle portion of the tape 213 in the width direction.

On the other hand, when the second tape cartridge 201*b* is mounted, the mounting bottom surface 11 and the far-side wall surface 221 are in close proximity to each other (see FIG. 5). Accordingly, the pushing protrusion 105 protruding from the mounting bottom surface 11 in the direction opposite the mounting direction comes in contact with the far-side wall surface 221 of the second tape cartridge 201*b* and is pushed in the mounting direction, and the pressurizing position switching portion 69 moves to the second switching position while compressing the pressurizing position switching spring 71 (see FIG. 10). In the above state, when the mounting portion lid 5 is closed and the pressurizing position switching portion 69 pushed by the head pressurizing frame 67 pivots towards the thermal head 17, the second contact pin 97*b*, between the two contact pins 97, comes in contact with the pressure receiving portions 47 of the head holder 37. With the above, the second contact pin 97*b* becomes the position where pressure is applied to the thermal head 17. Note that the second contact pin 97*b* comes in contact with the pressure receiving portions 47 at, with respect to the portion where the pressure receiving portions 47 come in contact with the first contact pin 97*a* when the first tape cartridge 201*a* is mounted, a portion in the direction opposite the mounting direction.

When the pressurizing position switching portion 69 is positioned at the second switching position, as described above, the second contact pin 97*b* is, in the mounting direction, positioned at substantially the same position as that of the width-direction middle portion of the tape 213 accommodated in the second tape cartridge 201*b*. Accordingly, when the second tape cartridge 201*b* is mounted as well, the center of the pressure applied to the tape 213 pinched between the thermal head 17 and the platen roller 205 is substantially the middle portion of the tape 213 in the width direction. Subsequently, when the second tape cartridge 201*b* is removed from the cartridge mounting portion 7, the pressurizing position switching portion 69 is pushed by the pressurizing position switching spring 71 in the direction opposite the mounting direction and automatically returns to the first switching position.

Note that when the third tape cartridge is mounted, the frame-side connection portions 77 of the head support frame 65 becomes the position where pressure is applied to the thermal head 17. The frame-side connection portions 77 are positioned in the direction opposite the mounting direction with respect to the second contact pin 97*b*. The frame-side connection portion 77 is at substantially the same position as that of the width-direction middle portion of the tape 213 accommodated in the third tape cartridge. Accordingly, when the third tape cartridge is mounted as well, the center of the pressure applied to the tape 213 pinched between the thermal head 17 and the platen roller 205 is substantially the middle portion of the tape 213 in the width direction.

As described above, according to the head pressurizing mechanism 51 of the present exemplary embodiment, when the first tape cartridge 201*a* is mounted, the pressurizing position switching portion 69 is positioned at the first switching position and the first contact pin 97*a* becomes the position where pressure is applied to the thermal head 17. Furthermore, when the second tape cartridge 201*b* is mounted, the pressurizing position switching portion 69 is pushed in the mounting direction by the second tape cartridge 201*b* and moves from the first switching position to the second switching position; accordingly, the second contact pin 97*b* becomes the position where pressure is applied to the thermal head 17. As described above, the position where pressure is applied to the thermal head 17 can be switched by having the pressurizing position switching portion 69 move in the direction that is the same as the direction in which the second tape cartridge 201*b* is mounted. Accordingly, a complex structure for moving the pressurizing position switching portion 69 does not have to be provided, and the size of the head pressurizing mechanism 51 can be reduced.

Furthermore, since the position where pressure is applied to the thermal head 17 can be switched, the center of the pressure applied to the tape 213 pinched between the thermal head 17 and the platen roller 205 is substantially the middle portion of the tape 213 in the width direction when either of the first tape cartridge 201*a* or the second tape cartridge 201*b* is mounted. Accordingly, since pressure is applied to the tape 213 in the width direction of the tape 213 in a good balanced manner, unevenness in the print density in the width direction of the tape 213 can be suppressed and printing can be performed favorably.

Other Modifications

Not limited to the exemplary embodiment described above, it goes without saying that various configurations that do not depart from the scope of the present disclosure can be adopted. For example, the exemplary embodiment described above can be, other than that described above, modified into the following configurations.

Not limited to the configuration in which the pressurizing position switching portion 69 is not pushed in the mounting direction with the first tape cartridge 201*a* when the first tape cartridge 201*a* is mounted, the pressurizing position switching portion 69 may be pushed in the mounting direction. In other words, when the first tape cartridge 201*a* is mounted, the amount in which the pressurizing position switching portion 69 move in the mounting direction may be smaller than the amount in which the pressurizing position switching portion 69 moves in the mounting direction when the second tape cartridge 201*b* is mounted.

The configuration of the head pressurizing mechanism 51 is not limited to one in which, interlocked with the closing of the mounting portion lib 5, the head pressurizing frame 67 applies pressure to the thermal head 17 through the pressurizing position switching portion 69. For example, interlocked with the mounting of the second tape cartridge 201*b*, the head pressurizing frame 67 may apply pressure to the thermal head 17 through the pressurizing position switching portion 69 before the mounting portion lib 5 is closed. Such a configuration can be fabricated by providing, in the cartridge mounting portion 7, an actuating member that pivots the head pressurizing frame 67 by engaging with the mounted second tape cartridge 201*b*. Note that desirably, the second tape cartridge 201*b* pushes the pressurizing position switching portion 69 towards the mounting direction before the second tape cartridge 201*b* engages with the actuation member so that the pressurizing position switching portion 69 moves in the mounting direction before the head pressurizing frame 67 pivots.

Furthermore, the exemplary embodiment described above and the modifications may be combined.

Additional Statement

Hereinafter, additional statements of the head pressurizing mechanism and the tape printing apparatus will be given.

A head pressurizing mechanism that presses a thermal head towards a platen roller, the thermal head being provided in a cartridge mounting portion on which a first tape cartridge and a second tape cartridge, each accommodating tape of a different width, are selectively mounted, the head pressurizing mechanism including a pressurizing position switching portion provided on a side opposite the platen roller with respect to the thermal head, and a pressurizing portion that applies pressure to the thermal head through the pressurizing position switching portion. In the head pressurizing mechanism, the pressurizing position switching portion includes a first contact portion and a second contact portion provided, with respect to the first contact portion, in a direction opposite a mounting direction of the first tape cartridge and the second tape cartridge. In a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion in the mounting direction with the second tape cartridge, the second contact portion is positioned at a second switching position in which the second contact portion comes in contact with the pressure receiving portion at, with respect to the first switching position, a portion in a direction opposite the mounting direction.

With such a configuration, the position where pressure is applied to the thermal head can be switched by having the pressurizing position switching portion move in the direction that is the same as the direction in which the second tape cartridge is mounted. Accordingly, a complex structure for moving the pressurizing position switching portion does not have to be provided, and the size of the head pressurizing mechanism can be reduced.

In the above configuration, desirably, the pressurizing position switching portion further includes a holder that holds the first contact portion and the second contact portion, and a pushing protrusion that protrudes from the holder and that comes in contact with the second tape cartridge.

With such a configuration, the holder holding the first contact portion and the second contact portion can be moved in the mounting direction by having the pushing protrusion come in contact with the second tape cartridge.

Desirably, the above configuration further includes an elastic member that applies force in the direction opposite the mounting direction to the pressurizing position switching portion.

With such a configuration, the pressurizing position switching portion that has moved to the second switching position when the second tape cartridge had been mounted can be made to automatically move to the first switching position when the second tape cartridge is removed.

In the above configuration, desirably, the thermal head is supported by a head shaft that extends in the mounting direction, and the pressurizing position switching portion is supported by the head shaft so as to be moveable in the mounting direction.

With such a configuration, by using the head shaft, the pressurizing position switching portion can be moved in the mounting direction in a smooth manner.

A tape printing apparatus includes a cartridge mounting portion on which a first tape cartridge and a second tape cartridge, each accommodating tape of a different width, are selectively mounted, a thermal head provided in the cartridge mounting portion, and a head pressurizing mechanism that presses the thermal head towards a platen roller. In the tape printing apparatus, the head pressurizing mechanism includes a pressurizing position switching portion provided on a side opposite the platen roller with respect to the thermal head, and a pressurizing portion that applies pressure to the thermal head through the pressurizing position switching portion. The pressurizing position switching portion includes a first contact portion, and a second contact portion provided, with respect to the first contact portion, in a direction opposite a mounting direction of the first tape cartridge and the second tape cartridge. In a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion towards the mounting direction with the second tape cartridge, the second contact portion is positioned at a second switching position in which the second contact portion comes in contact with the pressure receiving portion at, with respect to the first switching position, a portion in the direction opposite the mounting direction.

With such a configuration, the position where pressure is applied to the thermal head can be switched by having the pressurizing position switching portion move in the direction that is the same as the direction in which the second tape cartridge is mounted. Accordingly, a complex structure for moving the pressurizing position switching portion does not have to be provided; accordingly, the size of the head pressurizing mechanism can be reduced and, consequently, the size of the tape printing apparatus can be reduced.

In the above configuration, desirably, the pressurizing position switching portion further includes a holder that holds the first contact portion and the second contact portion, and a pushing protrusion that protrudes from the holder and that comes in contact with the second tape cartridge.

With such a configuration, the holder holding the first contact portion and the second contact portion can be moved in the mounting direction by having the pushing protrusion come in contact with the second tape cartridge.

What is claimed is:

1. A head pressurizing mechanism that presses a thermal head towards a platen roller, the thermal head being provided in a cartridge mounting portion on which a first tape cartridge and a second tape cartridge, each accommodating tape of a different width, are selectively mounted, the head pressurizing mechanism comprising:

a pressurizing position switching portion provided on a side opposite the platen roller with respect to the thermal head; and a pressurizing portion that applies pressure to the thermal head through the pressurizing position switching portion, wherein the pressurizing position switching portion includes, a first contact portion, and a second contact portion provided, with respect to the first contact portion, in a direction opposite a mounting direction of the first tape cartridge and the second tape cartridge, in a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion in the mounting direction with the second tape cartridge, the second contact portion is positioned at a second switching position in which the second contact portion comes in contact with the pressure receiving portion at, with respect to the first switching position, a portion in a direction opposite the mounting direction.

2. The head pressurizing mechanism according to claim 1, wherein the pressurizing position switching portion further includes, a holder that holds the first contact portion and the second contact portion, and a pushing protrusion that protrudes from the holder and that comes in contact with the second tape cartridge.

3. The head pressurizing mechanism according to claim 1, further comprising, an elastic member that applies force in the mounting direction to the pressurizing position switching portion.

4. The head pressurizing mechanism according to claim 1, wherein the thermal head is supported by a head shaft that extends in the mounting direction, and the pressurizing position switching portion is supported by the head shaft so as to be moveable in the mounting direction.

5. A tape printing apparatus comprising:

a cartridge mounting portion on which a first tape cartridge and a second tape cartridge, each accommodating tape of a different width, are selectively mounted;

a thermal head provided in the cartridge mounting portion; and a head pressurizing mechanism that presses the thermal head towards a platen roller, wherein the head pressurizing mechanism includes, a pressurizing position switching portion provided on a side opposite the platen roller with respect to the thermal head, and a pressurizing portion that applies pressure to the thermal head through the pressurizing position switching portion, the pressurizing position switching portion includes, a first contact portion, and a second contact portion provided, with respect to the first contact portion, in a direction opposite a mounting direction of the first tape cartridge and the second tape cartridge, in a state in which the first tape cartridge is mounted, the first contact portion is positioned at a first switching position in which the first contact portion comes in contact with a pressure receiving portion provided on a side of the thermal head opposite the platen roller, and in a state in which the second tape cartridge is mounted, by pushing the pressurizing position switching portion in the mounting direction with the second tape cartridge, the second contact portion is positioned at a second switching position in which the second contact portion comes in contact with the pressure receiving portion at, with respect to the first switching position, a portion in the direction opposite the mounting direction.

6. The tape printing apparatus according to claim 5, wherein the pressurizing position switching portion further includes, a holder that holds the first contact portion and the second contact portion, and a pushing protrusion that protrudes from the holder and that comes in contact with the second tape cartridge.

* * * * *